US008662431B2

(12) United States Patent
Gronvall

(10) Patent No.: US 8,662,431 B2
(45) Date of Patent: Mar. 4, 2014

(54) CENTERING ROLLS

(75) Inventor: Lars Gronvall, Trelleborg (SE)

(73) Assignee: Metso Minerals (Sweden) AB, Trelleborg (SE)

( * ) Notice: Subject to any disclaimer, the term of this patent is extended or adjusted under 35 U.S.C. 154(b) by 0 days.

(21) Appl. No.: 13/451,888

(22) Filed: Apr. 20, 2012

(65) Prior Publication Data

US 2013/0277472 A1 Oct. 24, 2013

(51) Int. Cl.
*B02C 4/32* (2006.01)

(52) U.S. Cl.
USPC ..... 241/101.3; 241/230; 241/231; 241/232; 241/233; 241/259.1; 241/259.3

(58) Field of Classification Search
USPC ..... 241/101.3, 230–233, 259.1, 259.3
See application file for complete search history.

(56) References Cited

U.S. PATENT DOCUMENTS

| | | | | |
|---|---|---|---|---|
| 312,623 | A * | 2/1885 | Ferrier | 241/64 |
| 1,383,529 | A * | 7/1921 | Conder et al. | 241/230 |
| 2,141,101 | A * | 12/1938 | Webster | 72/195 |
| 3,845,708 | A | 11/1974 | Liebert | |
| 4,168,806 | A | 9/1979 | Jakobs | |
| 5,005,775 | A * | 4/1991 | Jakobs | 241/232 |
| 5,601,242 | A * | 2/1997 | Andersen | 241/230 |
| 5,779,126 | A | 7/1998 | Chun | |
| 7,337,995 | B2 * | 3/2008 | Van Vooren et al. | 241/37 |

FOREIGN PATENT DOCUMENTS

| | | | |
|---|---|---|---|
| DE | 42 20 468 | A1 | 1/1994 |
| DE | 10 2007 059 073 | A1 | 6/2009 |
| FR | 563 684 | A | 12/1923 |

OTHER PUBLICATIONS

PCT International Search Report dated Jun. 18, 2013.
Extended EP Search Report dated Apr. 24, 2013.
English translation of FR 563 684.
English Abstract of DE 42 20 468.
English Abstract of DE 10 2007 059 073.

* cited by examiner

*Primary Examiner* — Shelley Self
*Assistant Examiner* — Onekki Jolly
(74) *Attorney, Agent, or Firm* — Andrus Intellectual Property Law, LLP

(57) ABSTRACT

The present invention relates to a roller grinder comprising two rollers, each mounted on a separate shaft, a fixation means, a guide member, and a first and a second end member. A center of the guide member is rotatably attached to the fixation means in a position, which in a horizontal direction is located centrally between said rollers. Each end of the guide member is attached to a first end of the first and second end members, respectively, by means of a joint, such that both the guide member and the first and second end members can rotate around the joint, and the first and second end members, respectively, are rotatably attached at a second end to a respective one of the shafts.

5 Claims, 1 Drawing Sheet

CENTERING ROLLS

FIELD OF THE INVENTION

The present invention relates to a roller grinder comprising two rollers, each mounted on a separate shaft, and a number of fixed or rotatable members.

BACKGROUND OF THE INVENTION

A common roller grinder, such as that disclosed in EP-516 952, consists of two rollers mounted on a shaft each. The shaft is in turn supported by a frame member such that the rollers are placed at a suitable distance from each other. The rollers rotate in opposite directions, towards each other, such that material to be ground is crushed in the gap which is created between the rollers. The rollers are also movable in the horizontal direction, towards and from each other, due to rotation of the frame members to which the shafts of the rollers are connected.

A problem with such roller grinders is that the rollers can be moved in the horizontal direction independently of each other. E.g., when larger material than intended is entered in the gap, the gap is widened since the larger material presses one or both of the rollers outwards, i.e. from each other in the horizontal direction. These independent movements are often off centre, as compared to the exact centre between the two rollers, which can lead to uneven wear of the roller grinder and/or a need for a stronger construction than really necessary, e.g. due to vibrations resulting from the mentioned off centre position. Also, independent movement of the rollers in the horizontal direction can lead to the rollers being located at different vertical levels during operation, the result being that the grinding is not performed at the exact centre between the two rollers but displaced horizontally, since one roller is located at a different vertical level than the other.

One solution to these problems would be to lock the rollers such that they cannot move in the horizontal direction, but that would in turn create larger problems due to the lack of flexibility relating to the size of the gap between the rollers. Further, such a solution would restrict the possibility of compensating for diameter changes of the rolls caused by wear.

SUMMARY OF THE INVENTION

It is an object of the present invention to mitigate the above problems, and to provide a roller grinder with automatic adjustment of the rollers such that they are constantly located at the exact same distance from the horizontal centre point between the rollers.

According to a first aspect of the present invention, these objects are achieved by a roller grinder comprising two rollers, each mounted on a separate shaft, a fixation means, a guide member, and a first and a second end member, wherein a centre of the guide member is rotatably attached to the fixation means in a position, which in a horizontal direction is located centrally between the rollers, each end of the guide member is attached to a first end of the first and second end members, respectively, by means of a joint, such that both the guide member and the first and second end members can rotate around the joint, and the first and second end members, respectively, are rotatably attached at a second end to a respective one of the shafts.

Such a solution is not only easy to manufacture and install and is cost efficient, but it is also a reliable and simple way of automatically and constantly controlling the movement of the rollers in the horizontal direction. The member arrangement described above is stable and durable, and any of the members can be easily exchanged if necessary.

The rotation of the guide member and the first and second end members may be limited such that the minimum angle between the horizontal plane and the members is >0°. A minimum angle of >0° both provides a maximum gap between the rollers and assures that the member arrangement does not get stuck in a completely straight configuration where the member arrangement cannot be rotated, and folded inwards and towards each other, on its own.

The guide member may be rotatable such that the maximum angle between the horizontal plane and the member is <±180°. Such a limited rotation is advantageous since it assures that the member arrangement does not get stuck in a completely folded together configuration where the member arrangement cannot be rotated, and folded outwards and from each other, on its own.

The roller grinder may further comprise at least one sensor for registering an unsymmetrical distribution of a material to be ground, and a device for alerting when such an unsymmetrical distribution has been registered.

In an embodiment, the roller grinder further comprises a driving device arranged to rotate said guide member. Thereby, it is possible to actively control a width of the gap between the rolls.

BRIEF DESCRIPTION OF THE DRAWINGS

This and other aspects of the present invention will now be described in more detail, with reference to the appended drawings showing a currently preferred embodiment of the invention.

DETAILED DESCRIPTION

Figure 1:
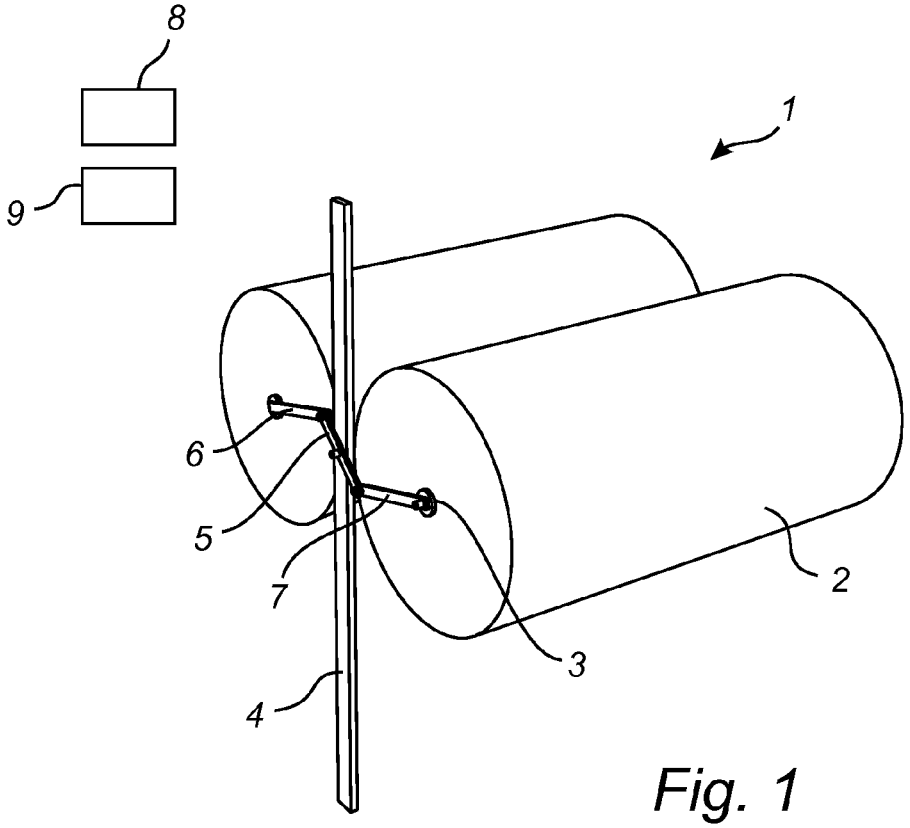
FIG. 1 shows a perspective view of a roller grinder according to the present invention.

FIG. 1 shows a roller grinder 1 comprising two rollers 2. Each roller 2 is mounted on a shaft 3 which coincides with the centre axis of the roller 2. A frame member is connected at one end to the shaft 3 such that the roller 2 can rotate, which is an essential feature during operation of the roller grinder 1. The frame member usually extends essentially vertically from the shaft 3 during at least part of its operation, e.g. during standstill.

The other end of the frame member is connected to the frame base of the roller grinder 1. The frame member can rotate around this second end to some extent during operation of the roller grinder 1. This rotational ability of the frame members and hence the rollers 2, i.e. the rotation around the connection to the frame, is necessary for adjusting the rollers 2 to, e.g., the size and/or amount of material to be ground. This adjustment is carried out automatically as the material presses at least one of the rollers 2 outwards, i.e. from each other in the horizontal direction.

The roller grinder 1 further comprises a fixation means 4, which is located centrally between the rollers 2, as seen in the horizontal direction. The fixation means could be any suitable fixation point on the machine, or a separate member e.g. extending vertically from the frame as shown in FIG. 1-2. The roller grinder 1 also comprises a guide member 5. The centre of the guide member 5 is rotatably attached to the fixation means 4 by means of a joint. The guide member 5 can rotate a maximum of less than 180° from the horizontal plane.

Figure 2A:
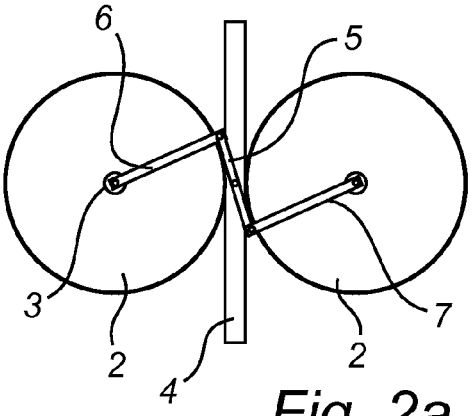
FIG. 2*a* shows a side view of the roller grinder according to FIG. 1, wherein the guide and end members form an essentially z-shaped line.
Figure 2B:
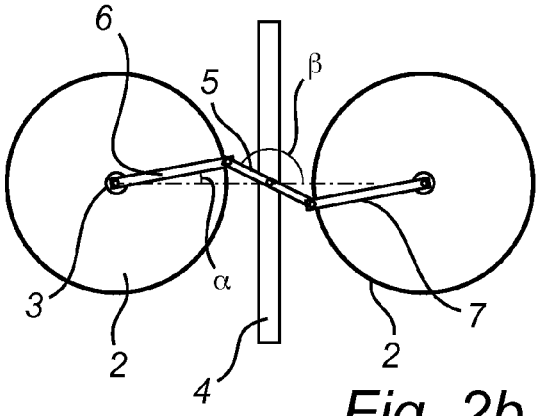
FIG. 2*b* shows a side view of the roller grinder according to FIG. 1, wherein the guide and end members form an almost straight line.

As shown more in detail in FIGS. 2*a* and 2*b*, each end of the guide member 5 is attached to a first end of a first 6 and second 7 end member, respectively, by means of a joint, such that both the guide member 5 and the first 6 and second 7 end members can rotate around the joint. The second end of the first 6 and second 7 end members, respectively, is preferably rotatably attached to a respective one of said shafts 3. The rotatable attachment comprises a joint, which is arranged such that said shaft 3 can rotate freely. However, the second ends of the first 6 and second 7 end members could also be attached to any other part of the rollers 2 which is suitable. In the embodiment shown, the guide member 5 is shorter than the first 6 and second 7 end members in order to create the desired patterns of movement. The members 5, 6, 7 can, on the one hand, form an almost straight line, i.e. when the rollers 2 are at the maximum distance from each other and the gap is as large as possible. The minimum angle $\alpha$ between the horizontal plane and the first 6 and second 7 end members is >0°. On the other hand, the guide member 5 and the first 6 and second 7 end members can form an essentially z-shaped (or even N-shaped), or upside-down z-shaped (or N-shaped), line when the rollers 2 are at the minimum distance from each other and the gap is as small as possible or almost non-existent. The maximum angle $\beta$ between the horizontal plane and the guide member 5 is <±180°.

Starting from the left hand shaft 3 and roller 2, the z-shape can be described as follows. A first end member 6 extends essentially horizontally from its second end, i.e. from the shaft 3, in a direction at least slightly upwards. From the first end of the first end member 6, the guide member 5 extends essentially diagonally, as compared to a vertical direction, downwards. From the opposite end of the guide member 5, the second end member 7 extends from its first end in an essentially horizontal direction, slightly upwards, such that its second end is attached to the right hand shaft 3.

Once again starting from the left hand shaft 3 and roller 2, the upside-down z-shape can be described as follows. A first end member 6 extends essentially horizontally from its second end, i.e. from the shaft 3, in a direction at least slightly downwards. From the first end of the first end member 6, the guide member 5 extends essentially diagonally, as compared to a vertical direction, upwards. From the opposite end of the guide member 5, the second end member 7 extends from its first end in an essentially horizontal direction, slightly downwards, such that its second end is attached to the right hand shaft 3.

The z-shape is not necessarily a perfect z, but it could be both an extended or pressed together version of a z. By "extended version" is meant that the angles between the legs of the z are larger than usual, and by "pressed together version" is meant that the angles between the legs of the z are smaller than usual. By "usual" is meant the angles between the legs of a perfect z, i.e. normally 45°.

The rotation of the guide member 5 and the first 6 and second 7 end members allows not only these two end positions (i.e. an almost straight line and an almost completely pressed together z-shape), but also all possible positions and angles there between.

The roller grinder 1 is also provided with at least one sensor 8 which can register any unsymmetrical distribution of a material to be ground, for example when the flow of material is directed more towards one of the rollers, as seen in the horizontal direction. Such an unsymmetrical distribution of material will lead to different, and therefore disadvantageous, loads on the rolls 2. An alerting device 9 will automatically alert when registering such an unsymmetrical distribution.

The person skilled in the art realizes that the present invention by no means is limited to the preferred embodiments described above. On the contrary, many modifications and variations are possible within the scope of the appended claims. For example, the guide member could be provided with multiple end members, arranged in series, at each end. The solution could be used in any type of crushing apparatus using rollers, and not only in a roller grinder. The roller grinder could comprise two rollers, but could also comprise e.g. one roller and another surface against which the roller rotates. Also, the second end members need not, as previously mentioned, be attached to the centre of the rollers, i.e. the shafts, but could be attached to the rollers in any other suitable way. Further, the sensor could be of any suitable kind, including pressure sensors and optical sensors.

A driving device could be arranged to apply a force to the guide member 5, thereby causing the guide member 5 to rotate a desired angle. In this manner, it would be possible to control the width of the gap between the rollers 2.

The invention claimed is:

1. Roller grinder comprising:

two rollers, each said roller mounted on a separate shaft wherein said shafts are coinciding with a center axis of the rollers a stationary fixation means located centrally between the center axes of the two rollers a guide member, and a first and a second end member each having a first end and a second end, wherein a center of said guide member is rotatably attached to said fixation means in a position, which in a horizontal direction is located centrally between said rollers, each end of said guide member is attached to the first end of said first and second end members, respectively, by means of a joint, such that both said guide member and said first and second end members can rotate around said joint, and said first and second end members, respectively, are rotatably attached at the second end to a respective one of said shafts.

2. Roller grinder according to claim 1, wherein the rotation of said guide member and said first and second end members is limited such that the minimum angle between the horizontal plane and said members is >0°.

3. Roller grinder according to claim 1, wherein said guide member is rotatable such that the maximum angle between the horizontal plane and said member is ≤±180°.

4. Roller grinder according to claim 1, wherein said roller grinder further comprises at least one sensor for registering an unsymmetrical distribution of a material to be ground, and an alerting device for alerting when such an unsymmetrical distribution has been registered.

5. Roller grinder according to claim 1, further comprising a driving device arranged to rotate said guide member.

* * * * *